US008465181B2

(12) United States Patent
Burt

(10) Patent No.: US 8,465,181 B2
(45) Date of Patent: Jun. 18, 2013

(54) RECESSED FIXTURE HOUSING HAVING REMOVABLE BALLAST BOX

(75) Inventor: Jonathan Burt, Tupelo, MS (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 649 days.

(21) Appl. No.: 12/697,239

(22) Filed: Jan. 30, 2010

(65) Prior Publication Data

US 2011/0188254 A1 Aug. 4, 2011

(51) Int. Cl.
*F21V 15/00* (2006.01)

(52) U.S. Cl.
USPC ..... 362/364; 362/365; 362/374; 362/375

(58) Field of Classification Search
USPC ..... 362/364, 365, 374, 375; 220/3.6
See application file for complete search history.

(56) References Cited

U.S. PATENT DOCUMENTS

| | | | |
|---|---|---|---|
| 1,264,015 | A | 4/1918 | Cochrane |
| 2,319,621 | A | 5/1943 | McLaughlin |
| 2,335,218 | A | 11/1943 | Vacha |
| 2,489,245 | A | 11/1949 | Sola |
| 2,702,378 | A | 2/1955 | Talty |
| 2,757,818 | A | 8/1956 | Chamberlain |
| 2,842,281 | A | 7/1958 | Chisholm |
| 3,057,993 | A | 10/1962 | Gellert |
| 3,082,023 | A | 3/1963 | Rudolph et al. |
| 3,144,502 | A | 8/1964 | Weiss |
| 3,168,613 | A | 2/1965 | Palmer |
| 3,247,368 | A | 4/1966 | McHugh |
| 3,281,522 | A | 10/1966 | Anisfield |
| 3,360,152 | A | 12/1967 | Leers |
| 3,420,995 | A | 1/1969 | Dunckel |
| 3,428,737 | A | 2/1969 | Pou |
| 3,495,024 | A | 2/1970 | Bowman |
| 3,597,889 | A | 8/1971 | Nigro |
| 3,630,406 | A | 12/1971 | Hammes |
| 3,647,934 | A | 3/1972 | Hurtt |
| 3,648,878 | A | 3/1972 | Mackay et al. |
| 3,715,627 | A | 2/1973 | D'Ausilio |
| 3,749,873 | A | 7/1973 | Harper et al. |
| 3,751,574 | A | 8/1973 | Fisher |
| 4,001,571 | A | 1/1977 | Martin |
| 4,039,822 | A | 8/1977 | Chan et al. |
| 4,041,657 | A | 8/1977 | Schuplin |
| 4,043,629 | A | 8/1977 | Brannen |
| 4,086,480 | A | 4/1978 | Lahm |
| 4,104,713 | A | 8/1978 | Chan et al. |
| 4,114,327 | A | 9/1978 | Williams |
| 4,146,287 | A | 3/1979 | Jonsson |
| 4,173,286 | A | 11/1979 | Stanko |
| 4,230,900 | A | 10/1980 | Speet |
| 4,230,916 | A | 10/1980 | Mochizuki |
| 4,247,738 | A | 1/1981 | Bonato |
| 4,272,689 | A | 6/1981 | Crosby et al. |
| D260,090 | S | 8/1981 | Hughes et al. |
| 4,367,417 | A | 1/1983 | Casasanta |
| 4,393,435 | A | 7/1983 | Petrina |
| 4,399,371 | A | 8/1983 | Ziff et al. |
| 4,408,262 | A | 10/1983 | Kusmer |

(Continued)

*Primary Examiner* — Mary Ellen Bowman

(57) ABSTRACT

A recessed fixture housing is provided with a removable ballast box. The removable ballast box is removably received in an aperture provided through the recessed fixture housing. At least one spring clip removably engages the ballast box and maintains the ballast box in position when the ballast box is received in the ballast box aperture.

19 Claims, 6 Drawing Sheets

U.S. PATENT DOCUMENTS 4,428,492 A 1/1984 Jorgensen
4,500,796 A 2/1985 Quin
4,507,719 A 3/1985 Quiogue
4,591,658 A 5/1986 Bauer et al.
4,605,816 A 8/1986 Jorgensen et al.
4,646,212 A 2/1987 Florence
4,661,885 A 4/1987 Brenner et al.
4,674,015 A 6/1987 Smith
4,686,381 A 8/1987 Boteler et al.
4,729,740 A 3/1988 Crowe et al.
4,741,434 A 5/1988 Liebman
4,751,624 A 6/1988 Russo et al.
4,754,377 A 6/1988 Wenman
4,829,410 A 5/1989 Patel
4,842,551 A 6/1989 Heimann
4,875,871 A 10/1989 Booty, Sr. et al.
4,897,627 A 1/1990 Van Wagener et al.
4,918,258 A 4/1990 Ayer
4,924,032 A 5/1990 Akins
4,958,048 A 9/1990 Bell
4,969,070 A 11/1990 Costa
4,979,616 A 12/1990 Clanton
5,006,764 A 4/1991 Swanson et al.
5,031,084 A 7/1991 Russo et al.
5,057,647 A 10/1991 Bogden et al.
5,064,385 A 11/1991 Harlow, Jr.
5,096,433 A 3/1992 Boundy
5,138,528 A 8/1992 Altman et al.
5,222,800 A 6/1993 Chan et al.
5,253,152 A 10/1993 Yang et al.
5,260,678 A 11/1993 Van Wagener et al.
5,272,279 A 12/1993 Filshie
5,347,088 A 9/1994 Marsh et al.
5,374,812 A * 12/1994 Chan et al. ..... 220/3.6
5,377,075 A 12/1994 Schmid et al.
5,410,462 A 4/1995 Wolfe
5,452,816 A 9/1995 Chan et al.
5,664,869 A 9/1997 Bitton
5,707,143 A 1/1998 Hentz
5,715,808 A 2/1998 Wilhoite
5,720,540 A 2/1998 Crown et al.
5,741,064 A 4/1998 Chin et al.
5,758,959 A 6/1998 Sieczkowski
5,800,050 A 9/1998 Leadford
5,836,678 A 11/1998 Wright et al.
5,845,988 A 12/1998 Mandall
5,857,766 A 1/1999 Sieczkowski
5,908,235 A 6/1999 Petrozello et al.
5,957,573 A 9/1999 Wedekind et al.
5,957,574 A 9/1999 Hentz et al.
6,062,704 A 5/2000 Holder
6,098,825 A 8/2000 Kohnen
6,102,550 A 8/2000 Edwards, Jr.
6,102,733 A 8/2000 Anderson, Jr. et al.
6,133,529 A 10/2000 Gretz
6,166,329 A 12/2000 Oliver et al.
6,272,794 B1 8/2001 Rippel et al.
6,290,375 B1 9/2001 Le Vasseur
6,293,510 B1 9/2001 Bradford et al.
6,369,326 B1 4/2002 Rippel et al.
6,383,032 B1 5/2002 Gergerding
6,659,627 B2 12/2003 Caluori
6,747,206 B1 6/2004 Law
6,777,611 B2 8/2004 Ewald et al.
7,357,541 B2 4/2008 Gamache et al.
2010/0110698 A1 * 5/2010 Harwood et al. ..... 362/365

* cited by examiner

RECESSED FIXTURE HOUSING HAVING REMOVABLE BALLAST BOX

CROSS-REFERENCE TO RELATED DOCUMENTS

Not Applicable.

TECHNICAL FIELD

This invention pertains generally to a recessed light fixture housing, and more particularly to a recessed light fixture housing having a removable ballast box.

BACKGROUND

Many recessed fixtures have a ballast box that holds a ballast for providing appropriate power to a light source of the recessed fixture. It is often desirable that once the recessed fixture is installed the ballast box be accessible by a user from the room side of the fixture. In other words, it is desirable that the ballast box be accessible by a user through a light aperture of the recessed fixture housing and so that it may be pulled into the interior of the recessed fixture housing for repair, replacement, inspection, etc. Related recessed fixtures having ballast boxes accessible

SUMMARY

Generally, in one aspect, a recessed fixture is provided having a pan with a light exit aperture, a plurality of housing sidewalls extending upwardly from the pan and a ballast box aperture is provided through at least one of the housing sidewalls. A ballast box is removably received in the ballast box aperture and has at least one wiring aperture for providing wiring into the light fixture housing. The ballast box has a sidewall with a recess notch and includes a stop structure along a periphery of the ballast box to engage the housing sidewall to prevent the ballast box from fitting through the ballast box aperture. At least one spring clip is provided on the housing sidewall adjacent the ballast box aperture. The spring clip removably engages the recess notch in the ballast box sidewall and maintains the ballast box in position when the ballast box is received in the ballast box aperture.

In some embodiments the spring clip has a v-shaped protrusion that removably engages the recess notch of the ballast box sidewall. In some versions of those embodiments the notch is a v-shaped notch generally corresponding in shape to the v-shaped protrusion of the sprint clip.

In some embodiments the fixture housing further includes a junction box extending from a second housing sidewall extending upwards from the pan. The junction box may have a first door and a second door. The first door may be accessible from exterior of an interior space defined by the plurality of sidewalls of the housing and the second door may be accessible from interior of the interior space.

In some embodiments the housing has a second spring clip opposed to the first spring clip on an edge of the ballast box aperture.

In some embodiments the ballast box has a first and a second fasteners and the sidewall having the ballast box aperture has mating first and second apertures for receiving the fasteners. The fasteners and the apertures are in mating relationship to provide for registration of the ballast box within the ballast box aperture.

Generally, in another aspect a recessed light fixture is provided having a housing resting on a pan, the pan having a downlight aperture. The housing extends upwardly from the pan. The housing includes a plurality of housing sidewalls and a housing top. The housing has an interior facing portion and an exterior facing portion. A ballast box aperture is provided through one sidewall of the plurality of sidewalls of the housing. A ballast box having a ballast box door is removably received in the ballast box aperture and has a spring clip notch provided thereon. The ballast box door has a handle and an area larger than the ballast box aperture. A spring clip is on the exterior facing portion of the housing adjacent the ballast box aperture and removably engages the spring clip notch when the ballast box is received in the ballast box aperture.

In some embodiments the spring clip has a v-shaped protrusion that removably engages the spring clip notch of the ballast box.

In some embodiments the spring clip has a protrusion that removably engages the spring clip notch of the ballast box and the spring clip notch generally corresponds in shape to the protrusion of the spring clip.

Generally, in another aspect a recessed fixture housing is provided having a pan, a downlight aperture provided through the pan, and a housing extending upwardly from the pan. The housing has an interior facing portion, an exterior facing portion, and a ballast box aperture provided therethrough. A housing top is atop the housing wall. A ballast box is removably received in the ballast box aperture. The ballast box has a main ballast box body having at least two spring clip notches and an access opening therethrough. A flange extends from the main ballast box body and a ballast box door is movably provided over the access opening. At least two spring clips are provided on the exterior facing portion of the housing wall adjacent the ballast box aperture. When the ballast box is received in the ballast box aperture the flange is adjacent the interior facing portion of the housing sidewall and the spring clips removably engage the spring clip notches.

In some embodiments the spring clips each have a protrusion that removably engages a single of the spring clip notches of the ballast box. In some versions of those embodiments the spring clip notches generally correspond in shape to the protrusion of the spring clip. The spring clip protrusions may optionally have an apex and a chamfered edge on each side of the apex. The spring clip may optionally be generally L-shaped, having a first leg coupled to the housing sidewall and a second leg extending away from the housing sidewall and having the protrusion thereon.

Generally, in another aspect a fixture housing includes a pan having a light exit aperture. A plurality of housing sidewalls extend upwardly from the pan; one of the sidewalls having a ballast box aperture provided therethrough. A ballast box is removably received in the ballast box aperture. The ballast box has a ballast box door with a handle formed thereon. The ballast box includes a sidewall with a spring clip receiving notch. The ballast box also includes a stop structure along a periphery of the ballast box door to engage the housing sidewall to prevent the ballast box from fitting through the ballast box aperture. At least one spring clip is on the housing sidewall adjacent the ballast box aperture. The spring clip removably engages the spring clip receiving notch in the ballast box sidewall and maintains the ballast box in position when the ballast box is received in the ballast box aperture. The ballast box door also has at least one fastener and the sidewall that has the ballast box aperture therein has mating apertures for receiving the fastener. The fastener and the aperture are in mating relationship to provide for registration of the ballast box door around the ballast box aperture.

BRIEF DESCRIPTION OF THE ILLUSTRATIONS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
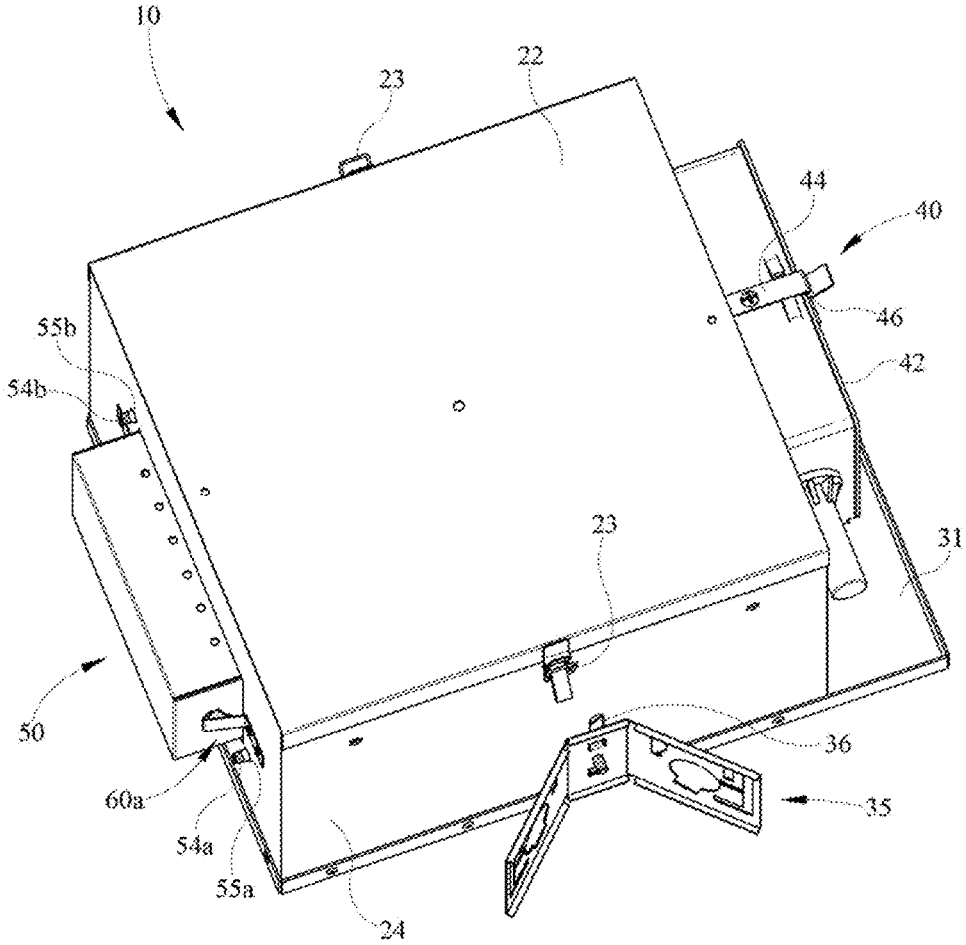
FIG. 1 is a top perspective view of an embodiment of the recessed fixture housing shown with a removable ballast box in the inserted position.
Figure 2:
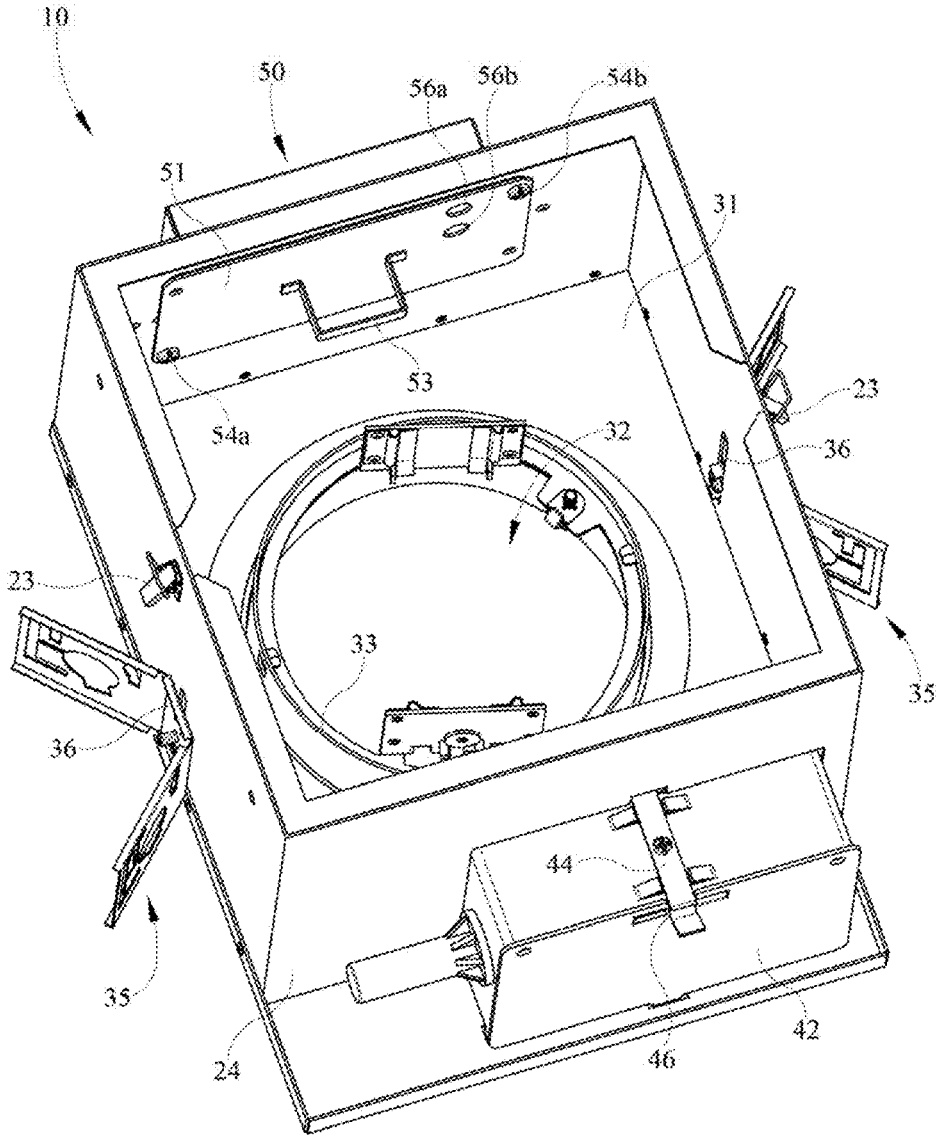
FIG. 2 is an additional top perspective view of the recessed fixture housing of FIG. 1 shown with a housing top removed and with the removable ballast box in the inserted position.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Many recessed fixtures have a ballast box that holds a ballast for providing appropriate power to a light source of the recessed fixture. It is desirable that once the recessed fixture is installed the ballast box be accessible by a user from the room side of the fixture. In other words, it is desirable that the ballast box be accessible by a user through the light aperture of the recessed fixture housing and without the need to remove the recessed fixture housing or go into the attic. The recessed fixture housing having a removable ballast box described herein allows for tool-less removal of a ballast box from the room side of the recessed fixture housing. In various embodiments spring clips are provided that engage the ballast box when it is in the installed position and retain the ballast box in position. A user can access the ballast box through the light aperture of the recessed fixture housing from the room side of the recessed fixture housing and provide sufficient force to disengage the ballast box from the remainder of the recessed fixture housing, allowing the ballast box to be pulled into the interior of the recessed fixture housing and, in some embodiments, out through the light aperture as desired by a user.

Referring now to FIG. 1 through FIG. 7, wherein like numerals refer to like parts, and initially particularly to FIG. 1 through FIG. 4, a first embodiment of a recessed fixture housing having a removable ballast box 10 is depicted. Recessed fixture housing 10 has housing structure including a housing top 22 shown in FIG. 1 atop a housing sidewall 24. Housing top 22 may be secured to housing sidewall 24 by latches 23 which may be secured to corresponding structure on housing top 22. Housing top 22 is removed in FIG. 2 through FIG. 4 for clarity in viewing the interior of recessed fixture housing 10. Housing sidewall 24 is riveted to and extends upwardly from a pan 31 or base of recessed fixture housing 10 having a light aperture 32 therethrough. The light aperture 32 provides a passageway for light from a light source to illuminate a desired area on the room side recessed fixture housing 10. A trim collar 33 is provided adjacent the light aperture 32 and includes mounting structure for supporting finishing trim and also for optionally supporting items such as a light source, reflector(s), and/or heat dissipating structure. Two mounting bar passageways 35 are provided on opposed sides of an exterior portion of housing sidewall 24 and may receive mounting bars or other structure for mounting recessed fixture housing 10. A fastener secures each mounting bar passageway 35 to the housing sidewall 24 and may be loosened and tightened to adjust the location of mounting bar passageways 35 along apertures 36 to adjust the vertical positioning of recessed fixture housing 10 when installed.

A junction box 40 sits adjacent the pan 31 and has protrusions that extend into corresponding apertures provided through the pan 31. Junction box 40 has an exterior junction box door 42 and an interior junction box door 43. Exterior junction box door 42 enables interior portions of the junction box 40 to be accessed from the attic side when recessed fixture housing 10 is installed. Interior junction box door 43 enables interior portions of the junction box 40 to be accessed from the room side through junction box aperture 27 provided through housing sidewall 24. A junction box door clip 44 is coupled to junction box 40 and has an interior door latch portion 45 that engages the interior junction box door 43 and an exterior latch portion 46 that engages the exterior junction box door 46. Interior door latch portion 45 works in combination with a tab extending from interior junction box door 43 into a corresponding aperture of pan 31 to maintain the interior junction box door 43 in position. Likewise, exterior door latch portion 46 works in combination with a tab extending from exterior junction box door 42 to maintain the exterior junction box door 46 in position. Force can be applied by a user to interior door latch portion 45 to move it away from interior junction box door 43 to allow interior junction box door 43 to be removed. Likewise, force can be applied by a user to exterior door latch portion 46 to move it away from exterior junction box door 42 to allow exterior junction box door 42 to be removed.

One of skill in the art will realize that many variations of the recessed fixture housing may be made in light of the teachings herein. For example, in alternative embodiments housing top 22 may be alternatively shaped, non-removable and/or integrally formed with housing sidewall 24. Also, for example, in alternative embodiments housing sidewall 24 may be alternatively shaped, integrally formed with housing top 22 and/or pan 31. Also, for example, in alternative embodiments light aperture 32 may take on alternative shapes, such as for example, a rectangular shape, and may include alternative adjacent mounting structure for supporting finishing trim and/or other items. Also, for example, in alternative embodiments a lamp support bar or other structure may be coupled to sidewall 24 or other portions of recessed fixture housing 10 and may support a light source, reflector, and/or heat dissipating structure. Also, for example, in alternative embodiments alternative junction boxes 40 may be provided, some of which may include one or more junction box doors that require tools for removal.

Figure 3:
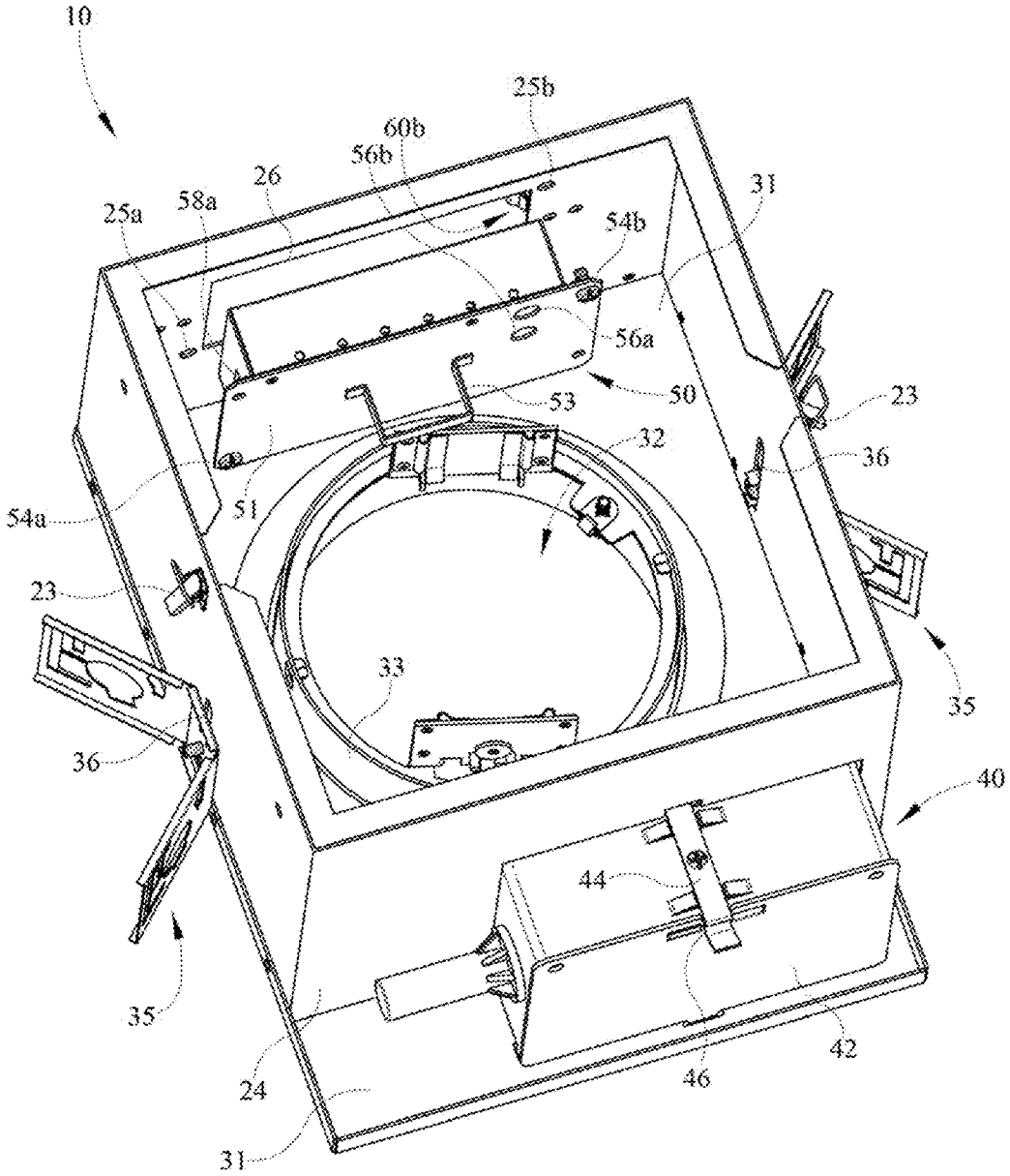
FIG. 3 is an additional top perspective view of the recessed fixture housing of FIG. 1 shown with the housing top removed and with the removable ballast box in the removed position.
Figure 4:
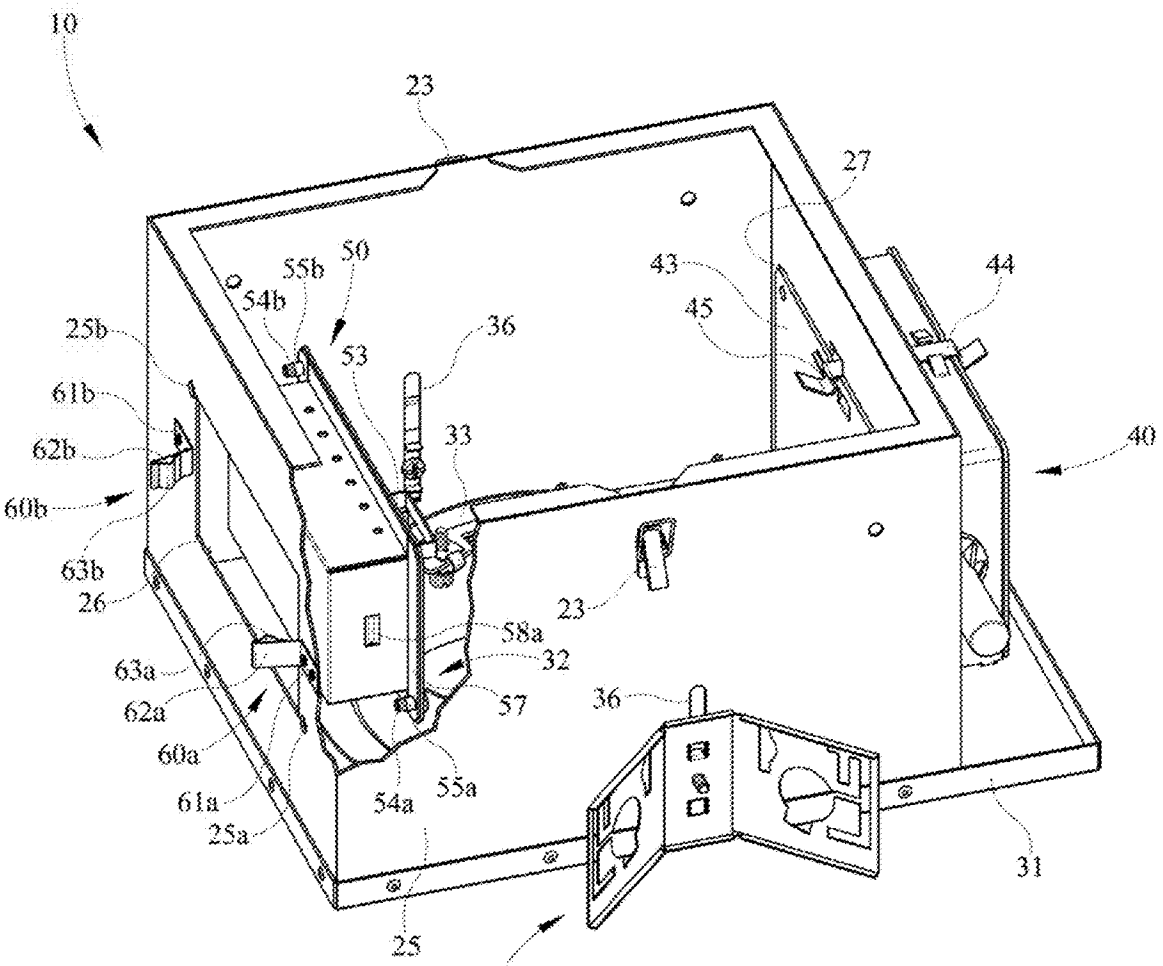
FIG. 4 is a side perspective view of the recessed fixture housing of FIG. 1 shown with the housing top removed, a portion of the housing sidewall near a ballast box aperture broken away, and with the removable ballast box in the removed position.
Figure 5:
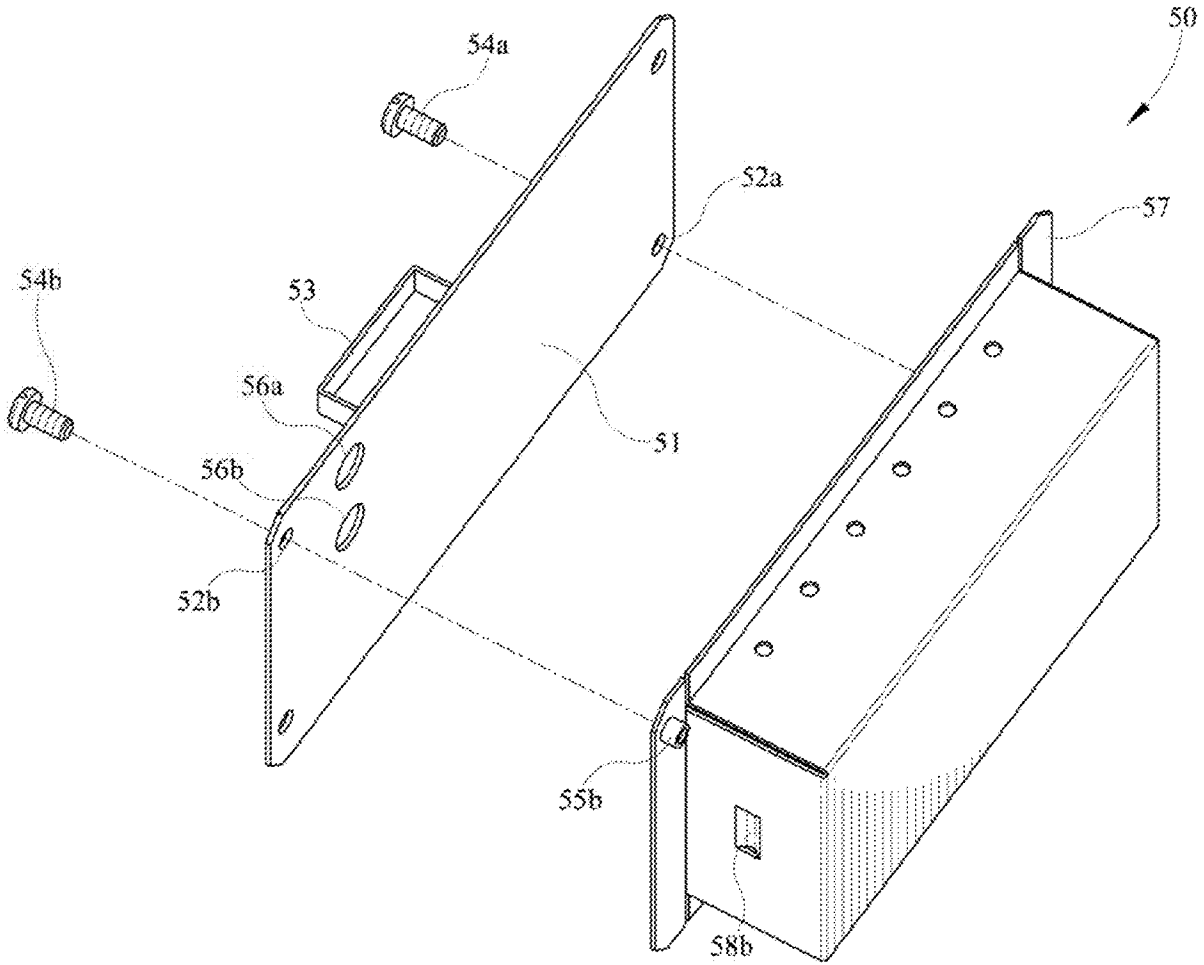
FIG. 5 is a top perspective view of the removable ballast box of the recessed fixture housing of FIG. 1, shown with a ballast box cover and two fasteners exploded away.
Figure 6:
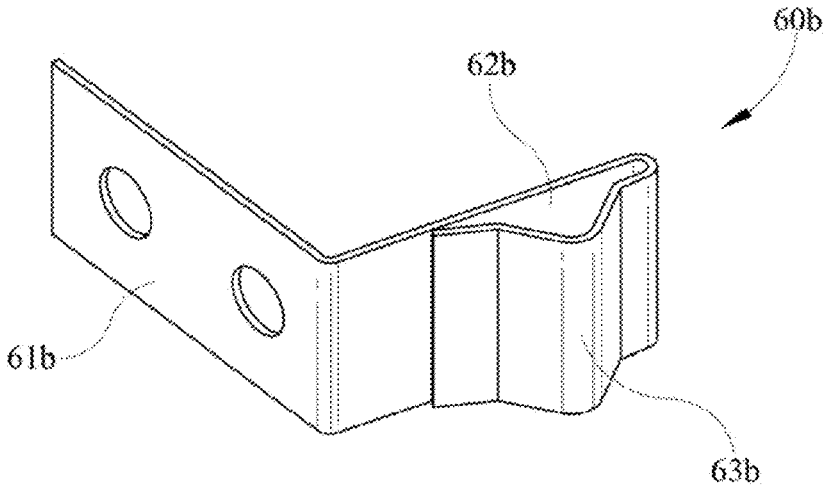
FIG. 6 is a top perspective view of one of the two spring clips of the recessed fixture housing of FIG. 1.
Figure 7:
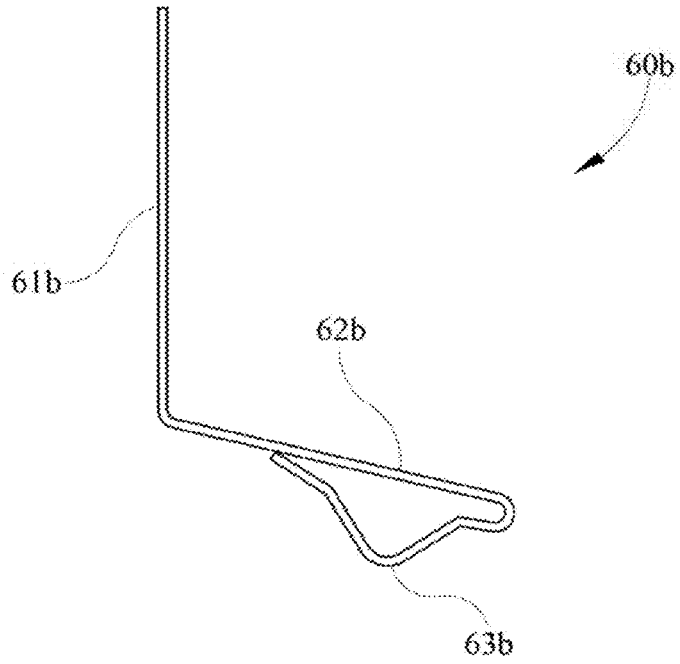
FIG. 7 is a top view of one of the two spring clips of the recessed fixture housing of FIG. 1.

With continuing reference to FIG. 1 through FIG. 4 and with additional reference to FIG. 5 through FIG. 7, a ballast box 50 and its connection to housing structure is described in detail. Ballast box 50 has a ballast box door 51 that is secured to the main body of ballast box 50 by two fasteners 54*a* and 54*b*. Fasteners 54*a* and 54*b* extend through apertures 52*a* and 52*b* in ballast box door 51 and are mated with bosses 55*a* and 55*b* provided on a peripheral flange 57 of the ballast box 50 main body. Ballast box door 51 may be removed to reveal an access opening that provides access to the interior portion of ballast box 50 to allow for the replacement or repair of one or more ballasts contained within the ballast box 50. A handle 53 extends from the ballast box door 51. Wiring apertures 56*a* and 56*b* are provided through the ballast box door 51 and allow for the passage of wiring from within the ballast box 50 to areas located exteriorly of the ballast box 50. Small airway apertures are provided through the main portion of ballast box 50 and allow for the passage of air therethrough to aid in cooling of any ballast(s) within ballast box 50.

Ballast box 50 may be removably received in a ballast box aperture 26 provided through sidewall 24. Fastener apertures 25*a* and 25*b* are also provided through sidewall 24 and enable portions of fasteners 54*a* and 54*b* to extend therethrough when ballast box 50 is placed in the installed position. In the depicted embodiment, fasteners 54*a* and 54*b* simply extend through apertures 25*a* and 25*b* and do not engage apertures 25*a* and 25*b*. Two spring clips 60*a* and 60*b* are provided on an exterior facing portion of sidewall 24 adjacent ballast box aperture 26. Spring clip 60*b*, which in the depicted embodiment is identical to spring clip 60*a*, is shown in greater detail in FIG. 6 and FIG. 7. The spring clips 60*a* and 60*b* are substantially L-shaped and each have a securing leg 61*a* and 61*b* that is coupled to housing sidewall 24 and a cantilever leg 62*a* and 62*b* that each have a substantially v-shaped protrusion 63*a* and 63*b* extending therefrom. The depicted protrusions 63*a* and 63*b* have a rounded apex with chamfered edges on each side of the apex. In alternative configurations other protrusions may be used, such as, for example, a protrusion that forms a portion of a sphere. When ballast box 50 is in the removed position, such as shown in FIG. 3 and FIG. 4, the depicted cantilever legs 62*a* and 62*b* are at an obtuse angle with respect to securing legs 61*a* and 61*b*, respectively, and are at an acute angle with respect to the ballast box aperture 26. More particularly, the depicted cantilever legs 62*a* and 62*b* are at approximately a one hundred and five degree angle with respect to securing legs 61*a* and 61*b*, respectively, and are at a sixty-five degree angle with respect to ballast box aperture 26. In alternative configurations cantilever legs 62*a* and/or 62*b* may be at an acute angle with respect to securing legs 61*a* and 61*b* and at an obtuse angle with respect to the ballast box aperture 26. For example, the cantilever legs 62*a* and/or 62*b* may be at an acute angle with respect to securing legs 61*a* and 61*b* and the protrusions 63*a* and/or 63*b* may be made larger such that they extend into the pathway of ballast box 50 as it is being installed and sufficiently engages corresponding structure on ballast box 50.

When ballast box 50 is being installed, protrusions 63*a* and 63*b* will engage ballast box 50 and slide across ballast box 50 until they engage notches 58*a* and 58*b* on ballast box 50. The depicted notches 58*a* and 58*b* are substantially v-shaped notches that substantially mirror the shape of protrusions 63*a* and 63*b*, having a rounded base with chamfered edges on each side of the base. When ballast box 50 is installed, flange 57 is adjacent the interior portion of the sidewall 24 and prevents the ballast box 50 from being forced exteriorly from the recessed fixture housing 10 by a user. The spring clips 60*a* and 60*b* sufficiently engage notches 58 to retain the ballast box 50 in position and prevent ballast box 50 from being forced interiorly into the recessed fixture housing 10 without force being applied to the ballast box 50 by a user or otherwise. When ballast box 50 is being removed, a user can pull on handle 53 with sufficient force to cause the spring clip protrusions 63*a* and 63*b* to disengage from notches 58*a* and 58*b* and slide across ballast box 50 until they are disengaged from ballast box 50. In the depicted embodiment the chamfered edges of the spring clip protrusions 63*a* and 63*b* aid in installation and removal of ballast box 50, allowing the protrusions 63*a* and 63*b* to more easily slide across ballast box 50 and to more easily disengage from notches 58*a* and 58*b*.

The construction elements of the recessed fixture housing 10 may in some embodiments incorporate stainless steel for the housing sidewall 24, pan 31, housing top 21, junction box 40, ballast box 50, and/or spring clips 60*a* and 60*b*. In some embodiments stainless steel may also be used for the hanger bar passageways 30 and the latches 23 and plastic may be used for the trim collar 33. Alternative configurations may incorporate alternative or additional materials for one or more of the constituent parts of the recessed fixture housing, such as, for example, other metals or plastic.

The foregoing description has been presented for purposes of illustration. It is not intended to be exhaustive or to limit the invention to the precise forms disclosed, and obviously many modifications and variations are possible in light of the above teaching. It is understood that while certain forms of the direct and indirect luminaire have been illustrated and described, it is not limited thereto except insofar as such limitations are included in the following claims and allowable functional equivalents thereof.

I claim:

1. A recessed light fixture, comprising:

a fixture housing including a pan, said pan having a light exit aperture;

a plurality of housing sidewalk extending upwardly from said pan, one of said sidewalls having a ballast box aperture provided therethrough;

a ballast box removably received in said ballast box aperture, said ballast box having at least one wiring aperture for providing wiring into said light fixture housing;

said ballast box having a sidewall with a recess notch;

said ballast box including a stop structure along a periphery of said ballast box to engage said housing sidewall to prevent said ballast box from fitting through said ballast box aperture, said stop structure preventing said ballast box from entering said ballast box aperture from outside of said light fixture housing; and at least one spring clip on said housing sidewall adjacent said ballast box aperture;

wherein said spring clip removably engages said recess notch in said ballast box sidewall and maintains said ballast box in position when said ballast box is received in said ballast box aperture.

2. The recessed light fixture of claim 1, wherein said spring clip has a v-shaped protrusion that removably engages said recess notch of said ballast box sidewall.

3. The recessed light fixture of claim 2, wherein said notch is a v-shaped notch generally corresponding in shape to said v-shaped protrusion of said spring clip.

4. The recessed light fixture of claim 1 wherein said fixture housing further has a junction box extending from a second of said housing sidewalls, said junction box having a first door and a second door, said first door accessible from exterior of an interior space defined by said plurality of sidewalls of said housing, said second door accessible from interior said interior space defined by said housing side walls.

5. The recessed light fixture of claim l wherein said housing has a second spring clip opposed to said first spring clip on an edge of said ballast box aperture.

6. The recessed light fixture of claim 1 wherein said ballast box has a first and a second fasteners and wherein said sidewall having said ballast box aperture has mating first and second apertures for receiving said fasteners, said fasteners and said apertures in mating relationship to provide for registration of said ballast box within said ballast box aperture.

7. A recessed light fixture, comprising:

a housing resting on a pan, said pan having a downlight aperture;

said housing extending upwardly from said pan, said housing including a plurality of housing sidewalk and a housing top, said housing having an interior facing portion and an exterior facing portion;

a ballast box aperture provided through one side wall of said plurality of side walls of said housing;

a ballast box having a ballast box door, said ballast box door having a handle, said ballast box door having an area larger than said ballast box aperture, thereby preventing said ballast box from entering said ballast box aperture from outside of said housing; said ballast box removably received in said ballast box aperture and having a spring clip notch provided thereon; and a spring clip on said exterior facing portion of said housing adjacent said ballast box aperture;

wherein said spring clip removably engages said spring clip note when said ballast box is received in said ballast box aperture.

8. The recessed light fixture of claim 7, wherein said spring clip has a v-shaped protrusion that removably engages said spring clip notch of said ballast box.

9. The recessed light fixture of claim 8, wherein said spring clip has a protrusion that removably engages said spring clip notch of said ballast box and said spring clip notch generally corresponds in shape to said protrusion of said spring clip.

10. The recessed light fixture of claim 9, wherein said recessed light fixture further includes a junction box having an interior door and an exterior door, said interior door of said junction box facing said downlight aperture.

11. The recessed light fixture of claim 7, wherein said spring clip has a securing leg coupled to said housing sidewall and a cantilever leg extending away from said housing sidewall and having a protrusion thereon.

12. The recessed light fixture of claim 11, wherein said cantilever leg is at an acute angle with respect to said ballast box aperture.

13. The recessed light fixture of claim 12, wherein said cantilever leg is at between a sixty nine and eighty one degree angle with respect to said ballast box aperture.

14. A recessed fixture housing, comprising:

a pan;

a downlight aperture provided through said pan;

a housing wall extending upwardly from said pan and having an interior facing portion, an exterior facing portion, and a ballast box aperture provided therethrough;

a housing top atop said housing wall;

a ballast box removably received in said ballast box aperture, said ballast box having a main ballast box body having at least two spring clip notches and an access opening therethrough, a flange extending from said main ballast box body, and a ballast box door movably provided over said access opening;

at least two spring clips on said exterior facing portion of said housing wall adjacent said ballast box aperture;

wherein when said ballast box is received in said ballast box aperture said flange is adjacent said interior facing portion of said housing sidewall and said spring clips removably engage said spring clip notches; and, wherein said flange permits said ballast box from being received in said ballast box aperture only when said ballast box enters said ballast box aperture from a direction originating inside of the recessed fixture housing.

15. The recessed fixture housing of claim 14, wherein said spring clips each have a protrusion that removably engages a single of said spring clip notches of said ballast box.

16. The recessed fixture housing of claim 15, wherein said spring clip notches generally correspond in shape to said protrusion of said spring clip.

17. The recessed fixture housing of claim 16, wherein said spring clip protrusions have an apex and a chamfered edge on each side of said apex.

18. The recessed fixture housing of claim 17, wherein said spring clip is generally L-shaped, having a first leg coupled to said housing sidewall and a second leg extending away from said housing sidewall and having said protrusion thereon.

19. A recessed light fixture, comprising:

a fixture housing including a pan, said pan having a light exit aperture;

a plurality of housing sidewalls extending upwardly from said pan, one of said sidewalls having a ballast box aperture provided therethrough;

a ballast box removably received in said ballast box aperture, said ballast box having a ballast box door with a handle formed thereon;

said ballast box having a sidewall with a spring clip receiving notch;

said ballast box also having a stop structure along a periphery of said ballast box door to engage said housing sidewall to prevent said ballast box from fitting through said ballast box aperture, said stop structure preventing said ballast box from entering said ballast box aperture from outside of said light fixture housing;

at least one spring clip on said housing sidewall adjacent said ballast box aperture;

said spring clip removably engages said spring clip receiving notch in said ballast box sidewall and maintains said ballast box in position when said ballast box is received in said ballast box aperture;

said ballast box door also having at east one fastener, said sidewall having said ballast box aperture therein having a mating apertures for receiving said fastener, said fastener and said aperture in mating relationship to provide for registration of said ballast box door around said ballast box aperture.

* * * * *